US005632160A

United States Patent [19]

Harangozo et al.

[11] Patent Number: 5,632,160

[45] Date of Patent: May 27, 1997

[54] REFRIGERATOR WITH IMPROVED AIR FLOW SYSTEM

[75] Inventors: Martin J. Harangozo, Louisville, Ky.; Brian S. Palka, Wynantskill, N.Y.

[73] Assignee: General Electric Company, Louisville, Ky.

[21] Appl. No.: 518,552

[22] Filed: Aug. 23, 1995

[51] Int. Cl.[6] ..... F25D 17/04; F25D 11/02

[52] U.S. Cl. ..... 62/408; 62/447

[58] Field of Search ..... 62/407, 408, 441, 62/447

[56] References Cited

U.S. PATENT DOCUMENTS

| | | | |
|---|---|---|---|
| 2,285,946 | 6/1942 | Kalischer | 62/6 |
| 3,025,683 | 3/1962 | Baker et al. | 62/419 |
| 3,169,383 | 2/1965 | Morton et al. | 62/419 |
| 3,455,119 | 7/1969 | Bright | 62/408 |
| 3,609,988 | 10/1971 | Bright | 62/187 |
| 4,539,819 | 9/1985 | Alba et al. | 62/78 |
| 4,768,353 | 9/1988 | Bushser | 62/408 |
| 4,920,765 | 5/1990 | McCauley et al. | 62/408 |
| 5,048,306 | 9/1991 | Wakatsuki et al. | 62/419 |
| 5,092,137 | 3/1992 | Elsom | 62/408 |
| 5,214,936 | 6/1993 | Lim et al. | 62/407 |
| 5,392,615 | 2/1995 | Lim | 62/414 |

*Primary Examiner*—William Doerrler
*Attorney, Agent, or Firm*—H. Neil Houser

[57] ABSTRACT

A refrigerator includes an upper freezer compartment and a lower fresh food compartment, with bottom and top walls respectively. A panel is mounted in front of the freezer rear wall to form a chamber containing an evaporator. An air flow separator, adjacent the rear of the compartments, extends through the freezer compartment bottom wall and the fresh food compartment top wall. It defines a first air passage for flow of relatively cold air to the fresh food compartment and a second air passage for return of relatively warm air to the evaporator chamber. A first member is mounted against the fresh food top wall to form a duct extending front to rear of the fresh food compartment. The duct is open adjacent the front of the fresh food compartment and communicates with the second air passage for return flow of warm air to the evaporator chamber. A second member is mounted against the panel within the freezer compartment to form a conduit communicating with the evaporator chamber and the first air passage for flow of cold air to the fresh food compartment. The conduit has at least one opening for discharge of cold air into the freezer compartment.

9 Claims, 3 Drawing Sheets

REFRIGERATOR WITH IMPROVED AIR FLOW SYSTEM

BACKGROUND OF THE INVENTION

The present invention relates to refrigerators and, more particularly, to top mount refrigerators in which the freezer compartment is positioned above the fresh food compartment. Typically such refrigerators have only a single evaporator to chill the air for both the freezer and the fresh food compartments. The evaporator normally is positioned in a chamber formed at the rear of the freezer compartment. Cold air is fed either from the freezer compartment or from the evaporator chamber to the fresh food compartment and warm air is returned from the fresh food compartment directly to the evaporator chamber. Normally both the cold air feed to and the warm air return from the fresh food compartment are located in the upper rear portion of the fresh food compartment, often in a substantially side-by-side configuration. This has a number of short comings. First the cold air entering the fresh food compartment may mix with the relatively warm air returning to the evaporator. This reduces the effective cooling of the fresh food compartment. Also the upper front portion of the fresh food compartment tends to be out of the circulation path of the air in the fresh food compartment and may become warmer than desired.

It is an object of this invention to provide an improved air flow system in a top mount refrigerator.

It is another object of this invention to provide such an improved system in which the cold air entering and the warm air returning from the fresh food compartment are effectively separated.

It is yet another object of the present invention to provide an improved system in which relatively warm air is returned to the evaporator from the upper front portion of the fresh food compartment.

SUMMARY OF THE INVENTION

In accordance with one form of the present invention a refrigerator includes an upper freezer compartment and a lower fresh food compartment separated by an insulating partition. An evaporator is positioned in a chamber formed at the rear of the freezer compartment. A conduit is connected to the evaporator chamber and conducts relatively cold air to the fresh food compartment. A member mounted against the insulating partition within the fresh food compartment forms a duct extending front to rear of the fresh food compartment. The duct has at least one opening adjacent the front of the fresh food compartment and communicates with the evaporator chamber to return relatively warm air to the evaporator chamber.

DETAILED DESCRIPTION OF PREFERRED EMBODIMENTS

Figure 1:
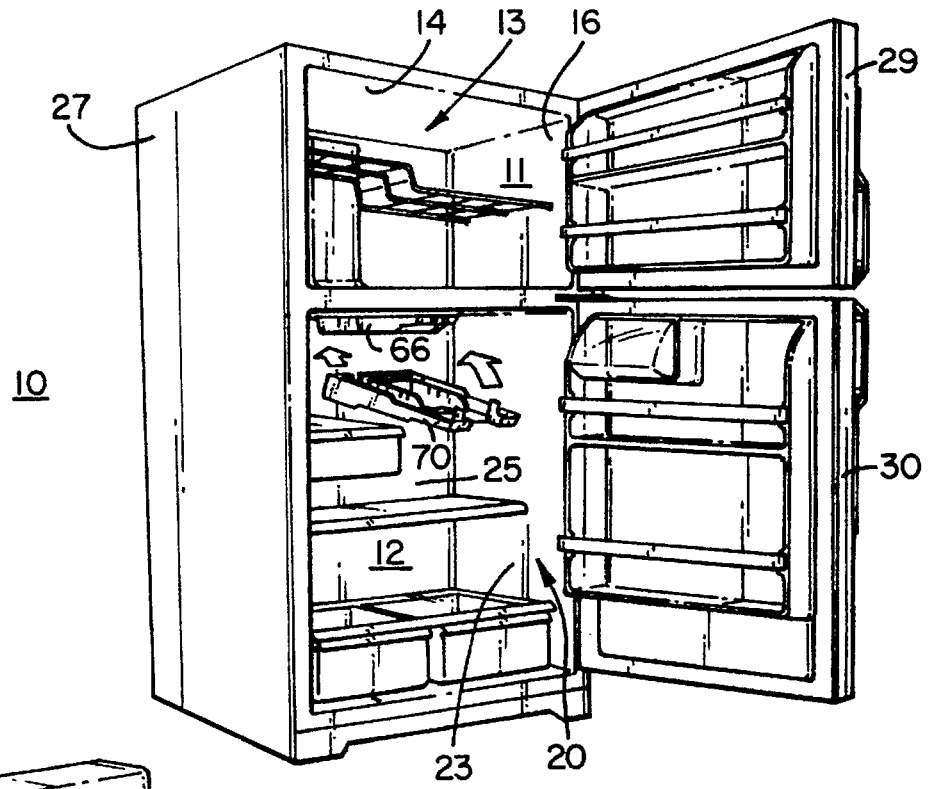
FIG. 1 is a somewhat schematic, front perspective view of a top mount refrigerator with the freezer and fresh food compartment doors open and with the fresh food air return duct member removed for purposes of illustration.

Referring now to the drawings there is illustrated a refrigerator 10 of the top mount type, in which the freezer compartment 11 is positioned above the fresh food compartment 12. The freezer compartment is formed by an open front, box like liner 13 having a top wall 14, a bottom wall 15, a pair of spaced apart side walls 16,17 and a rear wall 18. In a like manner, the fresh food compartment 12 is formed by an open front, box like liner 20 having a top wall 21, a bottom wall 22, a pair of spaced apart side walls 23,24 and a rear wall 25.

The liners 13 and 20 are positioned in an outer shell or housing 27 and the space between the housing and each liner and between the bottom wall 15 of the freezer liner 13 and the top wall 21 of the fresh food liner 20 is filled with a body 28 of insulation. Preferably the insulation is a foamed in place urethane material. The freezer bottom wall 15, fresh food top wall 21 and the insulation 28 between them form an insulating partition between the freezer compartment 11 and fresh food compartment 12. Alternatively the interior of the refrigerator 10 can be formed of an unitary open front, box like liner which defines the outer perimeter of both the freezer and the fresh food compartments. In that event a separate mullion of appropriate size and shape is formed with a top wall and a bottom wall separated by insulation. The mullion is mounted in the unitary liner to divide it into a freezer and a fresh food compartment. With that construction the mullion forms the insulating partition between the freezer and fresh food compartments, with the top wall of the mullion forming the bottom wall of the freezer and the bottom wall of the mullion forming the top wall of the fresh food compartment.

Doors 29 and 30 are mounted on the front of the housing to selectively close the open fronts of the freezer and fresh food compartments respectively. Conveniently a mechanical compartment, not shown, is formed below the rear portion of the fresh food compartment and contains various operating components such as the compressor and condenser.

Typically top mount refrigerators are refrigerated by a single evaporator located adjacent to the freezer compartment. In the illustrative refrigerator a panel 32 extends vertically between the freezer top wall 14 and bottom wall 15 and is spaced slightly forward of the freezer rear wall 18. This forms a chamber 33 at the rear of and separate from the freezer 11. An evaporator 34 is mounted in the chamber 33. The panel 32 is formed with inlet openings such as 35 (see FIG. 4) close to its lower end and an outlet opening 36 close to its upper end. A motor driven fan 37 is mounted in alignment with the outlet opening 36. The fan draws relatively warm air into the chamber 33 through the inlet openings 35, passes the air over evaporator 34 to chill it and to expels relatively cold air through the outlet opening 36.

An elongated member 40 of generally U-shaped cross-section is mounted against the panel 32 within the freezer. The member 40 overlaps the evaporator outlet opening 36 and extends downward to the bottom of the freezer 11 to form a cold air conduit 41. The member 40 has a number of slots 42 communicating with the freezer 11 so that a portion of the relatively cold air from the evaporator flows into the freezer.

Figure 2:
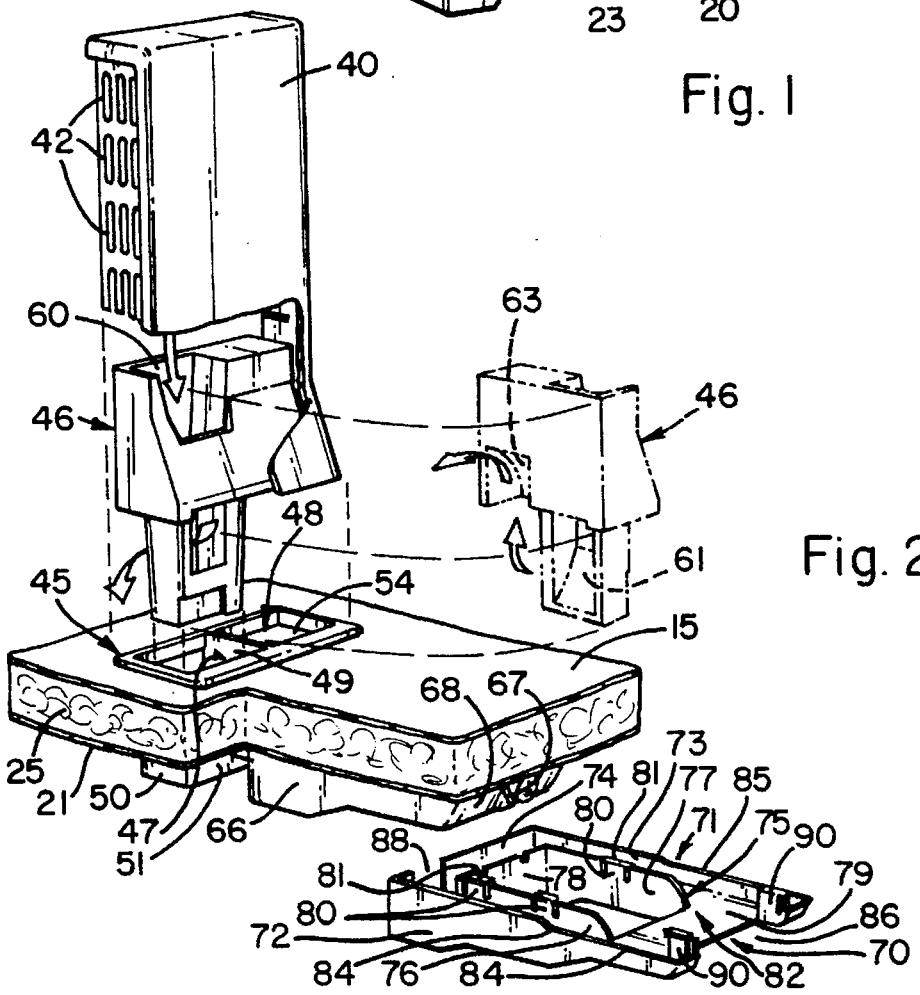
FIG. 2 is a fragmentary, exploded view of the partition separating the freezer and fresh food compartments, including the cold air supply conduit assembly and the warm air return duct.

Referring particularly to FIG. 2, the lower portion of the member 40 overlaps an air flow separator, which includes a channel member 45 and insulating insert 46. It will be understood that exploded FIG. 2 shows the insert 46 in one position in solid line and in another position in dashed line. The channel member is positioned close to the rear of the fresh food compartment 12 and extends through the insulating partition formed by freezer bottom wall 15, fresh food top wall 21 and the insulation 28 therebetween. The channel member 45 defines a cold air passageway 47 and a warm air passageway 48, separated by a solid wall 49. The channel member 45 also includes a side wall 50, spaced from the intermediate wall 49, a front wall 51 and a bottom wall 52 which define the passageway 47. The walls forming passageway 47 project below the fresh food top wall 21 and the rear of the passageway 47 is open to the fresh food compartment 12.

The channel member 45 also includes a side wall 54, front wall 55, rear wall 56 and bottom wall 57 that cooperate with intermediate wall 49 to define the passageway 48. The lower portions of the walls 54–56 and wall 57 include slots 58 for air flow. Alternatively these walls could be omitted below the fresh food top wall 21.

The left side of insulating insert 46, as seen in solid line in FIG. 2, forms a cold air passageway 60 which is received within passageway 47 in channel member 45. The insert 46 is open at the top of passageway 60 and includes an opening 61 at the lower end of passageway 60 which aligns with the open rear of passageway 47 below fresh food top wall 21. Thus relatively cold air flowing downward through the cold air conduit 41 will flow through the passageways 60 into the upper rear portion of the fresh food compartment 12.

The right side of insulating member 46, as seen in solid line in FIG. 2, abuts the top of channel member 45 around passageway 48 and defines a short, rear opening passageway 63 (see the dashed line view of insert 46 in FIG. 2). The passageway 63 connects the passageway 48 in air flow relationship with the inlet opening 36 at the bottom of panel 32. This forms a continuous passageway for relatively warm air to flow from the fresh food compartment 12 to the evaporator chamber 33.

A control housing 66 is mounted to the fresh food top wall 21 and is spaced slightly in front of the channel member 45. The housing contains various components for control of the operation of the refrigerator, particularly user adjustable controls like the thermostat. Control setting buttons or knobs, such as those shown at 67, are provided on the front wall 68 of housing 66.

Figure 4:
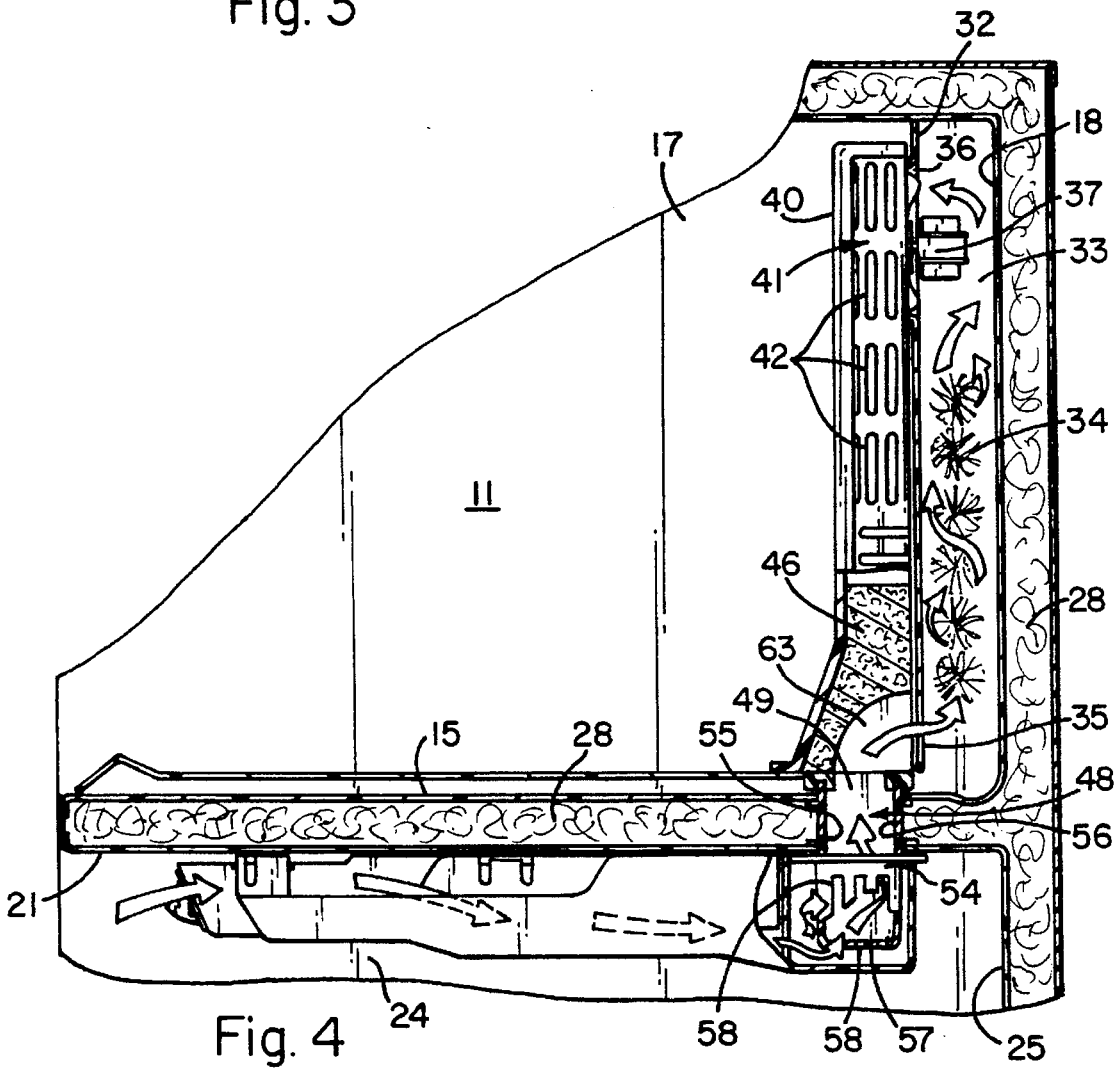
FIG. 4 is a cross-section view as seen along line 4—4 in FIG. 3.
Figure 6:
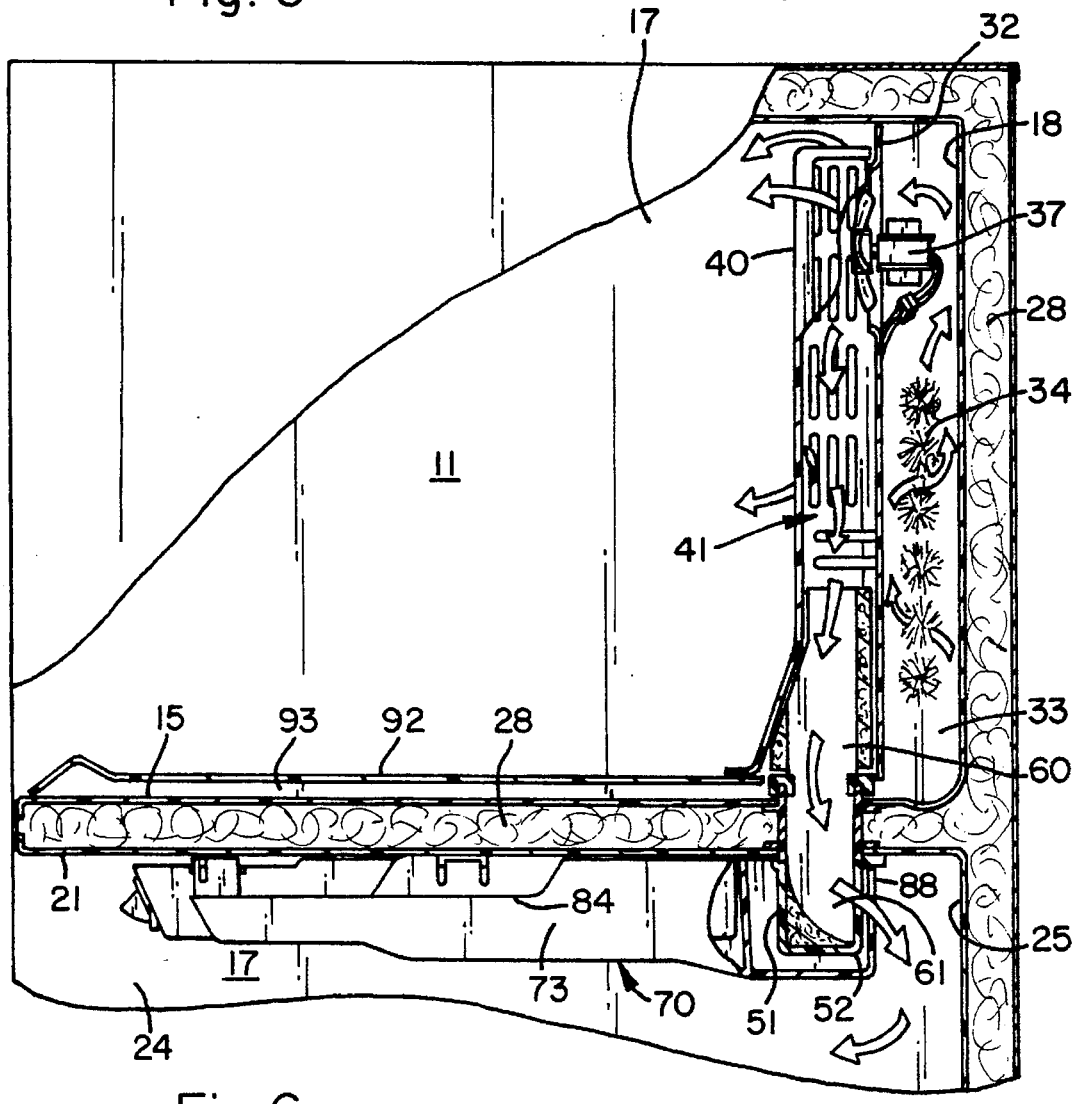
FIG. 6 is a cross-section view as seen along line 6—6 in FIG. 5.

Referring particularly to FIGS. 2, 4 and 6, a warm air return member 70 is mounted against the fresh food compartment top wall 21 around the control housing 66. The member 70 includes a generally U-shaped outer wall 71, with side portions 72,73 and a rear portion 74, and a generally U-shaped inner wall 75, with side portions 76,77 and a rear portion 78. A bottom wall 79 extends between the outer wall 71 and the inner wall 75.

The bottom wall 79 is omitted within the inner wall 75 and the inner wall 75 has integral resilient fingers 80 with inward projecting tabs 81. The member 70 is inserted over the control housing 66, with the housing fitting within the inner wall 75. As the member 75 moves up around the housing 66, the fingers 80 flex outward and then bias the tabs 81 between the housing 66 and the fresh food top wall 21. This securely mounts the member 70 against the top wall 21. The member 70 extends front to rear of the fresh food compartment from a position just inside the front of that compartment to a position behind the channel member 45. The member 70 and the top wall 21 form a warm air return duct 82; defined by top wall 21, outer wall 71, inner wall 75 and bottom wall 79. The side portions 72,73 of outer wall 71 are cut away at 84,85 respectively so as to be spaced below the top wall 21. This provides an opening on each side of duct 82 adjacent the front of the fresh food compartment for relatively warm air to flow from the compartment to the duct. The front of the outer wall 71 is provided with an opening 86. This provides an additional path for the flow of relatively warm air to the duct 82. In addition it provides the user with access to the control knobs 67. A post 90 extends upward on each side of the opening 86 and engages the fresh food top wall 21 to stabilize the front of member 70.

Referring to FIG. 6, the channel member walls 49–52 forming passageway 47 fit in duct 82 against rear wall portions 74 and spaced from rear wall portion 78. The opening 61 in passageway 60 registers with an opening 88 in outer wall rear portion 74. Thus relatively cold air from the evaporator chamber 33 flows through the conduit 41 and passageway 60 and is discharged into the upper rear portion of the fresh food compartment 12 behind outer wall rear portion 74. At the same time relatively warm in the duct 82 flows around the walls 49–52 without mixing with or otherwise effecting the temperature of the cold air.

Referring to FIG. 4, the channel member walls 49 and 54–57 fit within the duct 82 between rear wall portions 74,78 and air in duct 82 passes through the slots 58 in walls 54–57, flows through passageways 48 and 63 and enters the lower portion of evaporator chamber 33 through entrance opening 35. The relative warm air is drawn from the upper front of the fresh food compartment and does not mix with or otherwise materially effect the relatively cold air being discharged into the upper rear of the fresh food compartment.

Referring now to FIGS. 4 and 6, a horizontal platform 92 is positioned in the freezer compartment 11 just above the freezer bottom wall 15. The bottom wall 15 and platform 92 form a channel or duct 93 for returning relatively warm air to the evaporator chamber 33. To that end at least one opening (not shown) is formed in the lower portion of panel 32 in register with channel 93.

Figure 3:
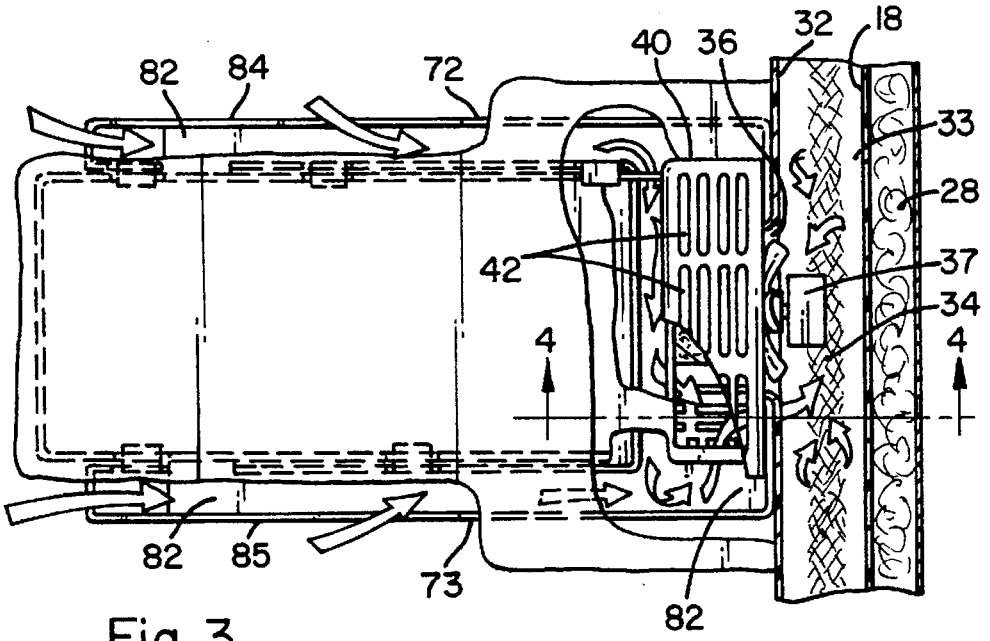
FIG. 3 is a fragmentary plan view of the assembly illustrated in FIG. 2, with some parts broken away for illustration, and illustrating the return flow of warm air from the fresh food compartment to the evaporator.
Figure 5:
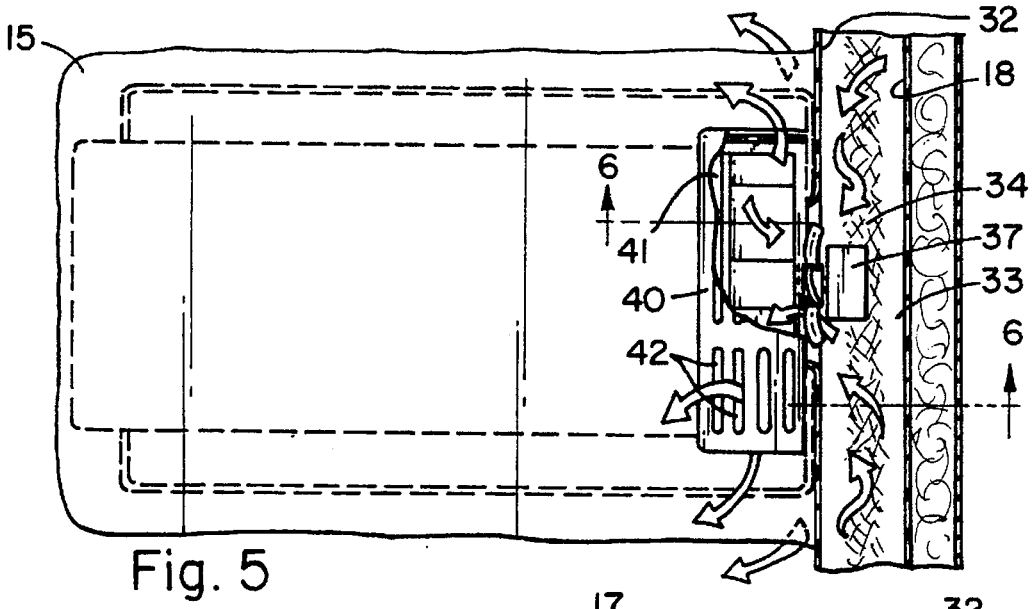
FIG. 5 is a view generally as seen in FIG. 3 but illustrating air flow form the evaporator chamber to the cold air conduit and to the freezer compartment.

The various air flow paths will be appreciated from viewing the flow arrows in FIGS. 3–6. In FIGS. 3 and 4 the arrows illustrate the flow of relatively warm air from the upper front of the fresh food compartment to the evaporator chamber 33 and over the evaporator 34. FIG. 5 illustrates the flow of cold air from the evaporator 34 into the freezer compartment 11. FIG. 6 illustrates the flow of air over the evaporator 34 and the flow of relatively cold air from the evaporator chamber 33 to both the freezer compartment 11 and the fresh food compartment 12.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerator comprising:

an upper freezer compartment, a lower fresh food compartment and an insulating partition separating said compartments;

an evaporator chamber separate from said freezer and fresh food compartments and positioned to the rear of said freezer compartment;

a conduit connected to said evaporator chamber for conducting relatively cold air from said evaporator chamber to said fresh food compartment, said conduit at least partially located in said freezer compartment and having at least one opening therein in communication with said freezer compartment so that when cold air from said evaporator flows through said conduit, at least some of the cold air flows from said conduit into said freezer compartment;

a member mounted against said insulating partition to form a duct extending front to rear within said fresh food compartment; and said duct having at least one opening adjacent the front of said fresh food compartment and said duct communicating with said evaporator chamber for returning relatively warm air to said evaporator chamber.

2. A refrigerator as set forth in claim 1, further comprising:

a flow separator extending through said insulating partition between said freezer and said fresh food compartments;

said flow separator defining first and second separate passages, said first passage connecting said conduit with said fresh food compartment for flow of relatively cold air to said fresh food compartment and said second passage connecting said duct with said evaporator chamber for flow of relatively warm air to said evaporator chamber.

3. A refrigerator as set forth in claim 1, further comprising:

a control housing mounted against said insulating partition within said fresh food compartment;

said member being mounted against said insulating partition about said control housing whereby said control housing is positioned within said duct.

4. A refrigerator as set forth in claim 3, wherein: said member has an open front for access to said control housing and flow of relatively warm air around said control housing.

5. A refrigerator comprising:

an upper freezer compartment and a lower fresh food compartment, said freezer and fresh food compartments having bottom and top walls respectively separated by insulation;

said freezer compartment having a rear wall, a panel positioned in front of said rear wall to form an evaporator chamber, an evaporator positioned in said chamber;

an air flow separator extending through said bottom and top walls and said insulation, and positioned adjacent the rear of said freezer and fresh food compartments, said separator comprising a channel member defining adjacent, first and second air passages separated by a wall, said first air passage communicating with said fresh food compartment to deliver relatively cold air to said fresh food compartment and said second air passage communicating with said fresh food compartment and said evaporator chamber to deliver relatively warm air from said fresh food compartment to said evaporator chamber; and a first member mounted against said fresh food compartment top wall to form a duct extending front to rear of said fresh food compartment, said duct having at least one opening adjacent the front of said fresh food compartment and said duct communicating with said second air flow passage to deliver relatively warm air to said second air passage.

6. A refrigerator as set forth in claim 5, further comprising:

a control housing mounted against said fresh food compartment top wall;

said first member being mounted about said control housing whereby said control housing is positioned within said duct.

7. A refrigerator as set forth in claim 6, wherein: said duct has an open front for access to said control housing and flow of relatively warm air around said control housing.

8. A refrigerator as set forth in claim 5, further comprising:

a second member mounted against said panel to form a conduit extending generally vertically along said panel in said freezer compartment;

said conduit communicating with said evaporator chamber and said first air passage to deliver relatively cold air to said fresh food compartment.

9. A refrigerator as set forth in claim 8, wherein: said conduit has at least one opening therein to deliver relatively cold air to said freezer compartment.

* * * * *